United States Patent [19]

Long

[11] 4,013,122

[45] Mar. 22, 1977

[54] DIVER'S GAS HEATER

[76] Inventor: Richard William Long, 760 Wakefield Court, San Diego, Calif. 92020

[22] Filed: May 5, 1975

[21] Appl. No.: 574,253

[52] U.S. Cl. ..... 165/154; 126/210; 128/188; 128/212

[51] Int. Cl.[2] ..... F28D 7/10

[58] Field of Search ..... 128/212, 188; 61/70; 165/154; 126/210

[56] References Cited

UNITED STATES PATENTS

| | | | |
|---|---|---|---|
| 3,105,708 | 10/1963 | Esty | 165/154 |
| 3,107,669 | 10/1963 | Gross | 128/212 |
| 3,616,796 | 11/1971 | Jackson | 128/212 |
| 3,762,392 | 10/1973 | Long | 126/210 |
| 3,865,106 | 2/1975 | Palush | 128/188 |
| 3,898,978 | 8/1975 | Marcus | 128/212 |

FOREIGN PATENTS OR APPLICATIONS

| | | | |
|---|---|---|---|
| 1,086,806 | 10/1967 | United Kingdom | 128/212 |

*Primary Examiner*—C. J. Husar
*Assistant Examiner*—Daniel J. O'Connor
*Attorney, Agent, or Firm*—Brown & Martin

[57] ABSTRACT

A diver's gas heater, for use with a hot water heated suit, to heat the diver's breathing gas for added comfort in cold water. Hot water from a surface installed source is pumped through a hose to the diver's suit and the heater is installed directly in the hot water supply hose. The hot water passes through a tubular heat exchanger and the breathing gas flows through an annulus around the water conducting tube. A portion of the hot water is tapped off to maintain heating around the short length of breathing gas hose between the heat exchanger and the diver's helmet.

5 Claims, 4 Drawing Figures

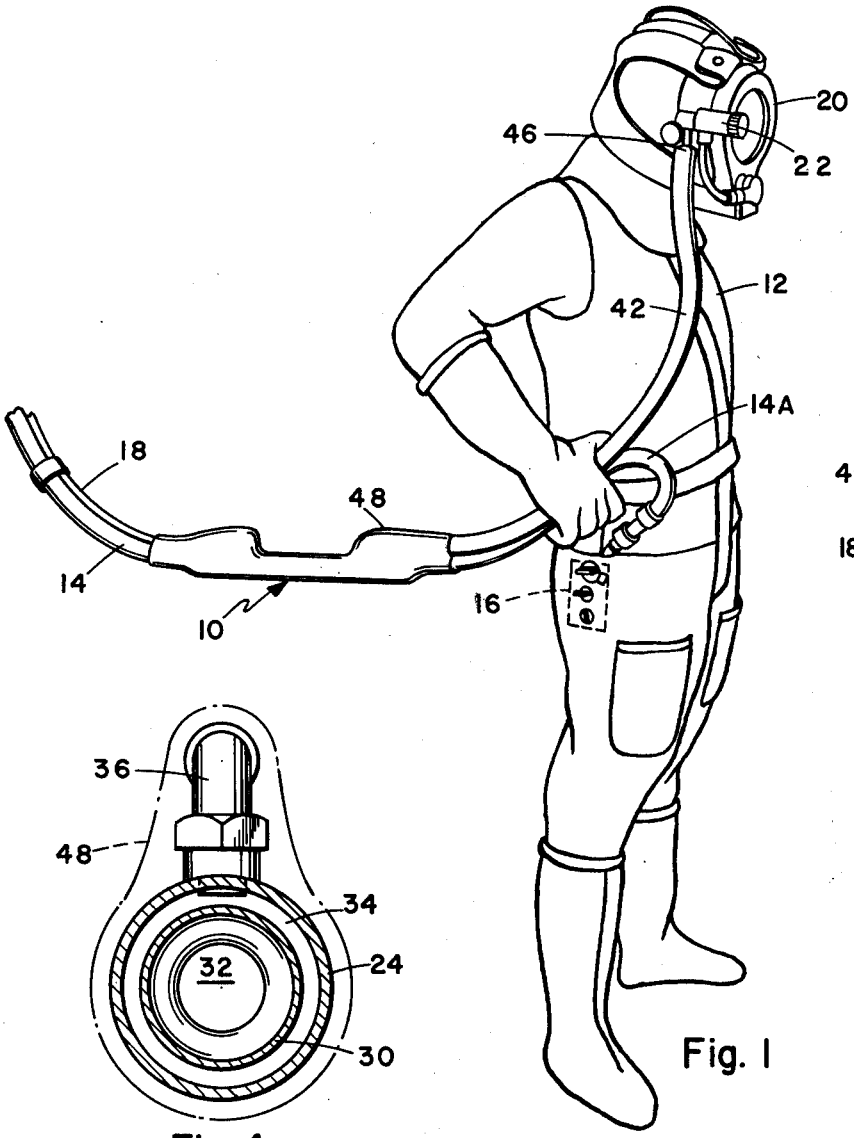
Fig. 1
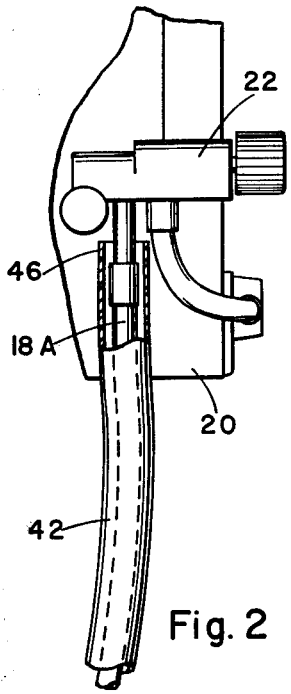
Fig. 2
Fig. 4
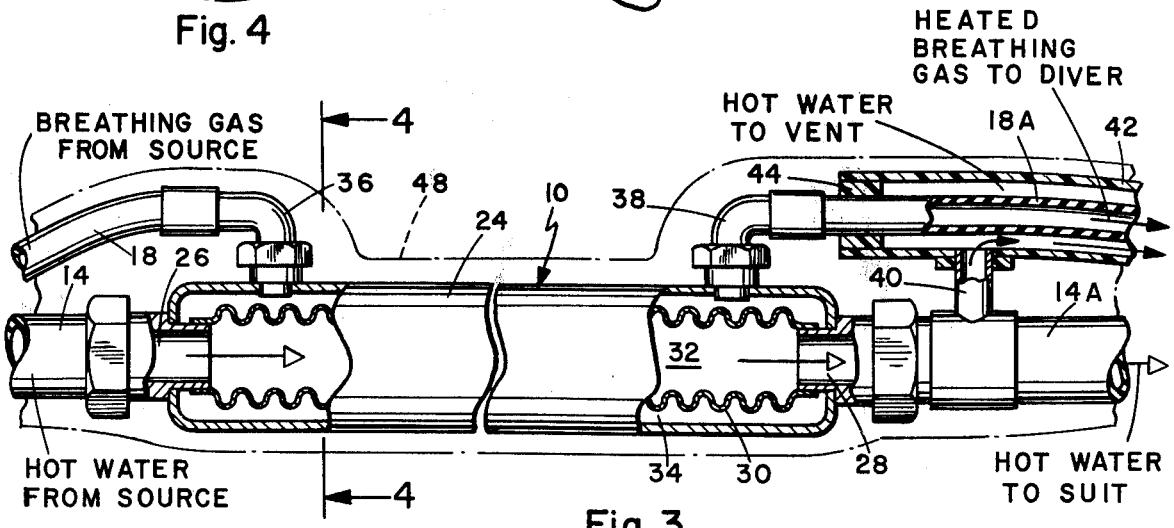
Fig. 3

DIVER'S GAS HEATER

BACKGROUND OF THE INVENTION

When diving in cold water, a diver can stay down for only a short period unless some type of heating is provided. One very successful type of heated suit is disclosed in U.S. Pat. No. 3,449,761, entitled "Heated Underwater Diving Suit". The associated hot water supply for the suit is described in U.S. Pat. No. 3,762,392, entitled "Hot Water Heater System for Divers". The suit is provided with valves for controlling heat and its distribution and the added comfort enables a diver to operate in cold water for a considerable length of time. However, the breathing gas, supplied from the surface along with the hot water, passes through a considerable length of hose exposed to the cold water. Insulation of the entire hose is impractical, but breathing the cold gas can be uncomfortable for the diver. Some form of heating the breathing gas, preferably without an additional power source, would be a great advantage in prolonging operating time of a diver.

SUMMARY OF THE INVENTION

The breathing gas heater described herein is a compact heat exchanger installed directly in the hot water supply hose leading to a diver's heated suit. The heat exchanger comprises a concentric tubular structure, the hot water being conducted straight through the inner tube and the breathing gas passing through the annulus between inner and outer tubes. From the outlet end of the heat exchanger the hot water supply leads to the suit controls and the breathing gas hose extends to the diver's helmet. Since even this short length of hose can suffer considerable heat loss, a portion of the hot water is tapped off and carried in an outer sleeve around the gas hose. The tapped off portion of hot water is vented to the surrounding water immediately adjacent the helmet.

There are no moving parts in the heat exchanger and maintenance is limited to an occasional cleaning. The unit is compact and can be installed in the supply lines close to the diver without interfering with activity. For added efficiency, the heat exchanger is enclosed in thermal insulation material, such as foam tape or the like wrapped around the unit and its connections.

The primary object of this invention, therefore, is to provide a new and improved diver's gas heater.

Another object of this invention is to provide a diver's gas heater for use with a hot water heated diver's suit.

Another object of this invention is to provide a diver's gas heater using a heat exchanger installed directly in the hot water and gas supply lines to a diver.

A further object of this invention is to provide a diver's gas heater which is compact, contains no moving parts and can be installed immediately adjacent a diver without encumbering his movements.

Other objects and advantages will be apparent in the following detailed description, taken in conjunction with the accompanying drawing, in which:

FIG. 1 illustrates a typical heated diving suit with the breathing gas heater attached.

FIG. 2 is an enlarged view, partially cut away, of the heated breathing gas connection to the helmet.

FIG. 3 is an enlarged side elevation view, with portions cut away, of the heating unit and its connections.

FIG. 4 is an enlarged sectional view taken on line 4—4 of FIG. 3.

DESCRIPTION OF THE PREFERRED EMBODIMENT

As illustrated in FIG. 1, the heater unit 10 is used in conjunction with a hot water heated diver's suit 12, to which hot water is supplied through a hose 14. The hose leads to a valve manifold 16 by which heat distribution in the suit is controlled, as described in above mentioned U.S. Pat. No. 3,449,761. Breathing gas is supplied through a hose 18 to the diver's helmet 20, the existing controls 22 remaining unchanged when the heater is added.

The heater unit 10 comprises an elongated tubular casing 24 having an inlet 26 at one end, to which hot water hose 14 is attached. At the other end of casing 24 is an outlet 28, from which hot water hose extension 14A leads to suit 12. Inside casing 24 is a corrugated inner tube 30 sealed at the ends to inlet 26 and outlet 28, to provide a straight through central water channel 32 and an outer annulus 34 between the casing and the inner tube. The corrugations in inner tube 30 provide a large heat exchange area for conducting heat from the hot water to the surrounding annulus 34, through which the breathing gas is passed.

Secured to casing 24 adjacent inlet 26 is an inlet elbow 36 opening into annulus 34 and to which the breathing gas hose 18 is connected. Adjacent outlet 28 is an outlet elbow 38 opening from annulus 34 to extension hose 18A, which leads to helmet 20.

The heater unit is, in effect, spliced directly into the water and breathing gas hoses and is installed near the diver. All of the hot water and all of the breathing gas pass through the heater unit for maximum efficiency, the essentially straight through flow causing negligible resistance to operation of the system. Normally the hoses are attached to the diver by tether means, not shown, to prevent the connections from being pulled loose. The existing tether means can also be used to prevent strain on the heater unit connections.

Since the extension breathing gas hose 18A from the heater unit to the helmet is several feet in length, exposure to the surrounding cold water could cause loss of much of the heat picked up by the gas in the heater. To avoid this loss a T-connection 40 is inserted in water hose 14A adjacent outlet 28, to tap off a small amount of the hot water to a sleeve or jacket 42, surrounding and coextensive with hose extension 18A. Jacket 42 is closed near outlet elbow 38 by any suitable seal 44. At the end near helmet controls 22 the jacket 42 has an open end 46, so that the hot water is dumped out after heating hose extension 18A. The hot water source at the surface can easily handle the continuous flow. After entering the heater unit, the breathing gas hose is thus heated continuously until it reaches the diver's helmet. The resultant warm gas is much more comfortable to breath than the cold gas which would be received without any heating, and greatly increases the diver's durability in cold water.

To avoid undesirable heat losses, the entire heater unit and its connections are preferably enclosed in some type of thermal insulation, as indicated at 48. The insulation may be molded in place or wrapped around the structure in the form of foam tape, or the like, various materials being suitable. Since there are no moving parts in the heater and the connections can be adequately sealed to withstand prolonged use, servicing is limited to an occasional flushing. The thermal insulation enclosure is thus not an inconvenience and has the added advantage of enclosing the various connections which might otherwise snag on obstructions and hamper the diver.

Having described my invention, I now claim:

1. A breathing gas heater for use with a hot water heated diver's suit, comprising:

a hot water heated diver's suit, an elongated tubular casing having a water inlet at one end with means for connection to a source of hot water, and a water outlet at the other end with means for connection to a diver's suit, an inner heat conducting tube fixed in said casing between said inlet and outlet and defining a central water conducting channel and an outer gas conducting annulus, a gas inlet in said casing adjacent said water inlet, opening into said annulus and having means for connection to a source of breathing gas, a gas outlet in said casing adjacent said water outlet, opening from said annulus and having diver's suit connection means for connection to the diver's suit, said diver's suit connection means comprises a gas extension hose attached to said gas outlet and extending to the diver's suit, a jacket surrounding and coextensive with said extension hose, and means for conducting hot water from the heater unit into said jacket.

2. A breathing gas heater according to claim 1, wherein said means for conducting hot water comprises a T-connection attached to said water outlet and connected into said jacket.

3. A breathing gas heater according to claim 2, wherein said jacket has an open end adjacent the diver's suit.

4. A breathing gas heater according to claim 1, wherein said inner tube is corrugated.

5. A breathing gas heater according to claim 1, wherein said casing and all connections thereto are enclosed in thermal insulation material.

* * * * *